US011117692B2

(12) United States Patent
Durand et al.

(10) Patent No.: US 11,117,692 B2
(45) Date of Patent: Sep. 14, 2021

(54) PROCESS AND MACHINE FOR REDUCING THE HEIGHT OF BOXES WITH A SQUARE OR RECTANGULAR CROSS SECTION

(71) Applicants: Claude Durand, Gemenos (FR); Frédéric Duffes, Roquevaire (FR); Robert Casanova, Marseilles (FR)

(72) Inventors: Claude Durand, Gemenos (FR); Frédéric Duffes, Roquevaire (FR); Robert Casanova, Marseilles (FR)

(73) Assignee: B+ Equipment, Gémenos (FR)

( * ) Notice: Subject to any disclaimer, the term of this patent is extended or adjusted under 35 U.S.C. 154(b) by 1343 days.

(21) Appl. No.: 14/373,404

(22) PCT Filed: Feb. 5, 2013

(86) PCT No.: PCT/FR2013/050238
§ 371 (c)(1),
(2) Date: Jul. 21, 2014

(87) PCT Pub. No.: WO2013/117852
PCT Pub. Date: Aug. 15, 2013

(65) Prior Publication Data

US 2015/0013278 A1 Jan. 15, 2015

(30) Foreign Application Priority Data

Feb. 8, 2012 (FR) ..... 12/00374

(51) Int. Cl.
*B65B 7/18* (2006.01)
*B65D 5/355* (2006.01)
(Continued)

(52) U.S. Cl.
CPC ..... *B65B 7/18* (2013.01); *B65B 7/16* (2013.01); *B65B 61/02* (2013.01); *B65D 5/0005* (2013.01);
(Continued)

(58) Field of Classification Search
CPC ..... B65B 59/00; B65B 59/02; B65D 5/00; B65D 5/32; B65D 5/20; B65D 5/06; B65D 5/42; B65D 5/44; B65D 5/48
(Continued)

(56) References Cited

U.S. PATENT DOCUMENTS 1,824,401 A * 9/1931 Kellogg ..... B65B 7/18 53/157
4,172,550 A * 10/1979 Garmon ..... B65D 5/48008 229/120.17
(Continued)

FOREIGN PATENT DOCUMENTS

FR 2878230 A1 5/2006
JP S48-66983 A 12/1946
(Continued)

OTHER PUBLICATIONS

International Search Report for corresponding International Application No. PCT/FR2013/050238.

*Primary Examiner* — Chelsea E Stinson
*Assistant Examiner* — Mary C Hibbert-Copeland
(74) *Attorney, Agent, or Firm* — Jon M. Isaacson

(57) ABSTRACT

Process for reducing the height of a box to the level of the apex of the stack of objects therein, wherein horizontal score lines are made at a height substantially equal to that of the apex of the stack of objects and such that the distance between the apex and the top of the box is greater than the half-width of the box. During a phase of simultaneous folding of the upper parts of the two side walls parallel to the length of the box toward the centre thereof, and before the upper edges or ridges of the upper parts meet, the angles of inclination of the upper parts are differentiated with respect to one another so that, when the upper parts meet, the upper edge of one covers the upper edge of the other, the upper
(Continued)

parts sliding over one another during the final phase of folding the latter.

9 Claims, 12 Drawing Sheets

(51) Int. Cl.

| | |
|---|---|
| ***B65B 7/16*** | (2006.01) |
| ***B65B 61/02*** | (2006.01) |
| *B31B 50/00* | (2017.01) |
| *B31B 110/35* | (2017.01) |
| *B31B 100/00* | (2017.01) |

(52) U.S. Cl.
CPC ..... *B31B 50/0044* (2017.08); *B31B 2100/00* (2017.08); *B31B 2110/35* (2017.08); *B65B 2210/04* (2013.01)

(58) Field of Classification Search
USPC ..... 53/504, 503, 76, 445, 458, 52, 486, 495
See application file for complete search history.

(56) References Cited

U.S. PATENT DOCUMENTS

| | | | | |
|---|---|---|---|---|
| 5,624,368 | A | 4/1997 | Cromwell | |
| 6,364,199 | B1 * | 4/2002 | Rose | B65D 5/0005 229/101 |
| 2009/0149306 | A1 * | 6/2009 | Durand | B65B 7/16 493/355 |

FOREIGN PATENT DOCUMENTS

| | | | |
|---|---|---|---|
| JP | S57-118807 | A | 1/1956 |
| JP | S58-104740 | A | 6/1983 |
| JP | H03-081817 | A | 8/1991 |

* cited by examiner

PROCESS AND MACHINE FOR REDUCING THE HEIGHT OF BOXES WITH A SQUARE OR RECTANGULAR CROSS SECTION

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a process and a machine for reducing the height of solid cardboard, corrugated or analog material consisting of rigid and deformable sheets with a square or rectangular cross section.

The technical domain of the invention is that of machines for packaging, cutting, setting up or closing containers or of manufacture and application of void-filling materials for such packing materials.

The present invention relates more particularly to the reduction of the height of boxes used for the filling of orders of single or multiple items and more generally of boxes used for packaging and shipping of diverse articles where the number and unitary volume, and hence also the overall volume, vary from one box to the next.

2. Description of Related Art Including Information Disclosed Under 37 CFR 1.97 and 37 CFR 1.98

It is known that boxes of this type are formed by machines from one or several blanks of a rigid, flexible material featuring several flaps, assembled by gluing or adhesive tape.

Known are also boxes which, after setting up, consist of five walls, namely a square or rectangular base and a girding of four lateral walls. The known boxes of this type are called 'American half-boxes', 'cardboard trays' or 'dome boxes'. These boxes are, once they are filled, closed by a lid. Known are lids which have four flaps which are bent down and glued to the sides of the box. Also known are lids where the various flaps have been performed by nesting or gluing; these lids are inserted on the top of the box and united with the box by gluing, stapling or a metal or plastic strap.

Also known are boxes which, after setting up, consist of five walls, like the boxes described previously, and four upper flaps. Each of these upper flaps is linked to one of the sidewalls by a folding line. The boxes of this type are called 'American boxes'. After these boxes have been filled they are closed by folding the four upper flaps which are kept in place by gluing, stapling or a metallic or plastic strap.

All boxes described above and, in general, most of the boxes used for packaging diverse articles have the common characteristic that they offer a constant volume once they have been set up and closed.

Various void-filling materials are often employed by the users or are integrated into the box-forming or closing machines, to immobilize the various objects the overall volume of which varies from one box to the next.

This solution presents numerous disadvantages. In fact:

- these void-filling products are often onerous;
- except when they are manufactured with the same material as the box itself, they must necessarily be separated from the cardboard box before collection and potential recycling of the corresponding waste; on the other hand these materials are, more often than not, difficult to recycle; this collection and this recycling are thus complex and very onerous operations;
- their implementation is difficult and requires either complex automated machines or is very labor-intensive; the cost of these operations is therefore high;
- the volume shipped which is equal to the volume of the manufactured box, is more often than not, very much larger than the useful volume which is equal to the volume of the objects located inside the box; this results in high transportation costs for said boxes.

Known are also methods which consist of reducing the height of the boxes in order to bring them as close as possible to the height of the packaged goods inside.

Known in particular is the method which consists of cutting off the top part of boxes, above the stack of goods, so as to reduce the height of the box to the useful height.

This method has disadvantages:

- cutting off the box is a delicate operation which implies the application of dangerous cutting tools;
- the automatic elimination of the cut-off high part of the box is a difficult operation which generates waste which must be collected and evacuated;
- automation of this process requires the installation of complex machinery.

Also known is the method which consists of cutting the four vertical ridges of the box, from the top of the box down to a height corresponding substantially to the top level of the packed goods, then making a horizontal score on each of the four lateral walls of the box at the same height, and then bending, toward the inside of the box, around these horizontal scores and with an angle substantially equal to 90°, the upper part of these four vertical walls. This method also permits reducing the height of the box to the useful height.

This method also presents disadvantages:

- cutting the four vertical ridges is a delicate operation which implies the application of dangerous cutting tools;
- these cutting operations generate dust polluting the content of the box;
- these cuttings reduce the overall strength of the box, in particular its resistance to vertical compression;

And finally one is familiar with the method which consists of:

- making a vertical score on each of the four vertical walls of the box at a height corresponding substantially to the top level of the goods packed inside the box;
- making, in each corner of the box, an oblique score one end of which is located at the level of the intersection between two of the horizontal scores and the other end is located at the level of the upper ridge of one of the lateral walls so that said oblique score forms an angle substantially equal to 45° with the horizontal plane.

finally bending toward the inside of the box, around these horizontal scores and with an angle substantially equal to 90°, the high part of these four vertical walls, by folding, one on top of the other, the different flaps separated by the oblique scores.

This method and the machine for its implementation are notably described in the WO-2006/053989 document.

BRIEF SUMMARY OF THE INVENTION

The invention concerns more particularly improvements made to the method and the machine described in this document.

This method offers advantages compared to the preceding methods to the extent that:

- it also allows reducing the height of the box to the useful height;
- it does not involve any cutting tools;
- it does not weaken the box but rather strengthens its resistance to vertical compression.

On the other hand, there are the following disadvantages:

- it is not possible to reduce the height of the box by a value above the half-width of this box; in fact, above this value, the upper ridges of the high part of the lateral walls which are folded back interfere with each other at the time of the folding and cannot be completely folded back at an angle substantially equal to 90°;
- folding the different flaps on top of each other, after having made the scores as described, generates stresses due to the resistance of the material used for producing the box, more specifically, when the folding angle between 2 flaps is substantially equal to 180°, and these stresses are such that these flaps have a strong tendency to unfold in order to resume their initial position and that it is difficult to keep them in the folded position, for example by gluing, said stresses having a tendency to break the bonds made by gluing;
- when the box is only very lightly filled and the distance between the horizontal scores and the bottom of the box is reduced, it is difficult to fold the high part of the sidewalls around said horizontal scores, as these sidewalls rather tend to pivot around the horizontal ridge which connects them to the bottom of the box.

So the problem to solve is to find a mean for reducing the height of a box as close as possible to the goods previously placed inside said box in case the reduction of the height to be achieved is greater than the half-width of said box, and this without removing a part of the box material or making any cuts on the box.

The aim of the invention is hence to provide a solution to the problem arising from the creation of a method and a machine allowing to reduce the height of a box made of a rigid and flexible material, consisting of a bottom and at least four sidewalls, by folding, over the top level of the stack of objects placed in said box, the high parts of said sidewalls of said box in such a manner that the height reduction obtained thereby can be greater than the half-width of the box.

The method used to achieve the height reduction of said box comprises, in a manner known per se, the following steps:

- in each of the sidewalls of said box a horizontal score is made, at a height distant from the bottom of the box;
- in the high part of each of the two sidewalls parallel to the length of the box, two oblique scores are made, each score having one end located at one of the ends of the horizontal score made on said wall and the other end located at the upper ridge of said wall and in such a manner that said oblique score forms an angle substantially equal to 45° to the horizontal plane;
- the high part of the two sidewalls parallel to the length of the box is folded toward the center of the box, around said horizontal score, with an angle substantially equal to 90°, the upper part of the sidewalls parallel to the width of the box is folded simultaneously toward the center of the box around said horizontal score, with an angle substantially equal to 90°, this swiveling of the upper parts of the sidewalls of the box leading simultaneously to the folding, one on top of the other, of the different flaps separated by said oblique scores which make up the high part of the sidewalls parallel to the length of the box, around said oblique scores and with an angle substantially equal to 180°.

This method is remarkable in that the horizontal scores are made at a height substantially equal to that of the top of said stack of objects and such that the distance between said top and the top of the box is greater than the half-width of said box; and in that, during the phase of simultaneous folding of the upper parts of the two sidewalls parallel to the length of said box toward the center of the box, and before the upper ridges or edges of said upper parts meet, the inclination angles of said upper parts are differentiated in relation to each other, so that, when said upper parts meet, the upper edge of one of said upper parts covers the upper edge of the other upper part, said upper parts sliding one on top of the other during their final folding phase.

The box height is thus reduced by a measure which can be greater than the half-width of said box without removal of a part of material of this box, or without making any cut on this box.

In an advantageous implementation of the method of the invention, one sees to it that, during the folding phase, the upper ridge of the upper part of one of the sidewalls parallel to the length of the box, is at first bent downward by a deflector and that simultaneously the upper edge of the upper part of the other sidewall parallel to the length of the box is bent upward by said deflector, then said deflector retracts under the pushing force of at least one of said ridges, so that said ridges do not interfere with each other and that the central flaps of the upper part of said sidewalls parallel to the length of the box are thus folded with an angle substantially equal to 90° and overlay each other partially in a substantially horizontal plane.

Advantageously, each of said horizontal scores and each of said oblique scores is obtained by crushing the material used for the manufacture of said box at the base of a score with a square, rectangular or triangular section under the action of a tool with an end that has a section that is substantially complementary to that of said score.

In an advantageous implementation, on each of the two sidewalls parallel to the width of said box a horizontal double-score is made consisting of two parallel horizontal scores close to each other, at a height substantially equal to that of the top level of said stack of items. Advantageously, two oblique double-scores are made on the high part of each of the two sidewalls parallel to the length of the box, each consisting of two oblique scores substantially parallel and close to each other, each of said oblique double-scores having one end located at one of the ends of the horizontal score or of the horizontal double-score made on said wall and in such a manner that said oblique double-score forms an angle substantially equal to 45° to the horizontal plane.

In an advantageous implementation, when the upper part of the two sidewalls parallel to the length of the box are folded back toward the center of the box, the lower part of these two walls is simultaneously kept in vertical position, for example with the help of suction cups.

These operations result in the height of the box being reduced to the useful height corresponding to the height of objects previously placed inside the box, including when the height reduction is greater than the half-width of said box.

This also results in the volume of the box being reduced close to the useful volume corresponding to the volume of the objects previously placed inside the box.

As a result, on the other hand, the action of fixing the objects positioned in the box can be easily reinforced by placing a lid on the upper part of the box and by the presence, between the objects and the lid, of different flaps folded back from the upper parts of the sidewalls of said box.

So, thanks to the invention, the objects placed inside the box are perfectly fixed and the volume of the box is reduced which cuts the shipping costs for the box, without having to add any kind of void-filling material other than the box itself, or without having to remove a part of the box material, or having to perform any cutting operations on that box.

The present invention concerns also a machine for reducing the height of a box consisting of a bottom and at least four sidewalls, by folding back the upper parts of said sidewalls of the box on top of the stack of goods previously placed inside, so that this height reduction may possibly be greater than the half-width of said box.

The machine concerned by the invention is of the kind, known as such, for example by the WO-2006/053989 document and featuring:

- means for producing, in each of the sidewalls, a horizontal score, at a height substantially equal to that of the top of said stack of goods;
- means for producing, in the upper part of each of the sidewalls parallel to the length of the box, two oblique scores, each of which has one end located at one end of the horizontal scores made in said wall and the other end located at the upper ridge of said wall and in such a manner that said oblique score forms an angle substantially equal to 45° to the horizontal plane;
- means for folding the upper part of the two sidewalls parallel to the length of the box toward the center of the box, around said horizontal score, at an angle substantially equal to 90°,
- means for folding simultaneously the upper part of the two sidewalls parallel to the width of the box toward its center, around said horizontal score, at an angle substantially equal to 90°, and for folding simultaneously, one on top of the other, the different flaps, separated by said oblique scores which compose the upper part of the sidewalls parallel to the length of the box, this machine being characterized in that it features means for producing, in each of said longitudinal and transversal sidewalls, a horizontal score, at a height so that the distance between said scores and the top of the box is at least equal to the half-width of said box; and in that it features means making it possible, during the simultaneous folding of the upper parts of the two sidewalls parallel to the length of the box toward its center and before the upper ridges or edges of said upper parts meet, to differentiate the inclination angles of said upper parts, so that, while the latter meet, the upper ridge or edge of one of the upper parts passes above the upper ridge or edge of the other upper part, said upper parts slide one on top of the other during the final folding phase of the latter.

In an advantageous implementation, said machine features means for deflecting downward the upper ridge of the high part of one of the sidewalls parallel to the length of the box, and means for simultaneously deflecting upward the upper edge of the high part of the other one of the sidewalls parallel to the length of the box during the folding of the upper parts of said sidewalls parallel to the length of the box.

Advantageously, for producing said horizontal scores and said oblique scores, the machine features assemblies for scores with for example, a square, rectangular, semi-circular or triangular section and tools that have one end with a section that is substantially complementary to that of said scores.

According to an advantageous implementation, the machine features means for producing, on each of the two sidewalls parallel to the width of the box, at least one horizontal double-score constituted by two horizontal scores that are parallel and close to each other.

Advantageously, the machine features means for producing, on each of the two sidewalls parallel to the length of the box, at least two oblique double-scores each constituted by two oblique scores, substantially parallel and close to each other.

According to an advantageous implementation, the machine features means for maintaining in vertical position the low part of each of the two sidewalls parallel to the length of the box, during the folding, toward the center of said box, of the high part of each of these two sidewalls.

BRIEF DESCRIPTION OF THE DRAWINGS

The advantages provided by the invention will be better understood through the following description which refers to the attached drawings which illustrate, without being in any way limiting, a particular implementation of a machine according to the invention.

Reference is made to the drawings to describe an interesting, although by no means limiting, example of the implementation of the method and realization of the machine according to the invention.

DETAILED DESCRIPTION OF THE INVENTION

As indicated before, the invention belongs in the domain of packing methods for diverse goods, providing scoring of the high parts of the sidewalls of the packing boxes and the folding back of these high parts towards the center of said boxes, as well as the machines enabling the implementation of these methods.

Advantageously, and more specifically focused, the subject of the invention are dispositions allowing the application of the method and the machine described in the WO-2006/053989 document to which it will be possible to refer, if necessary, for a good comprehension of the present invention.

Figure 1:
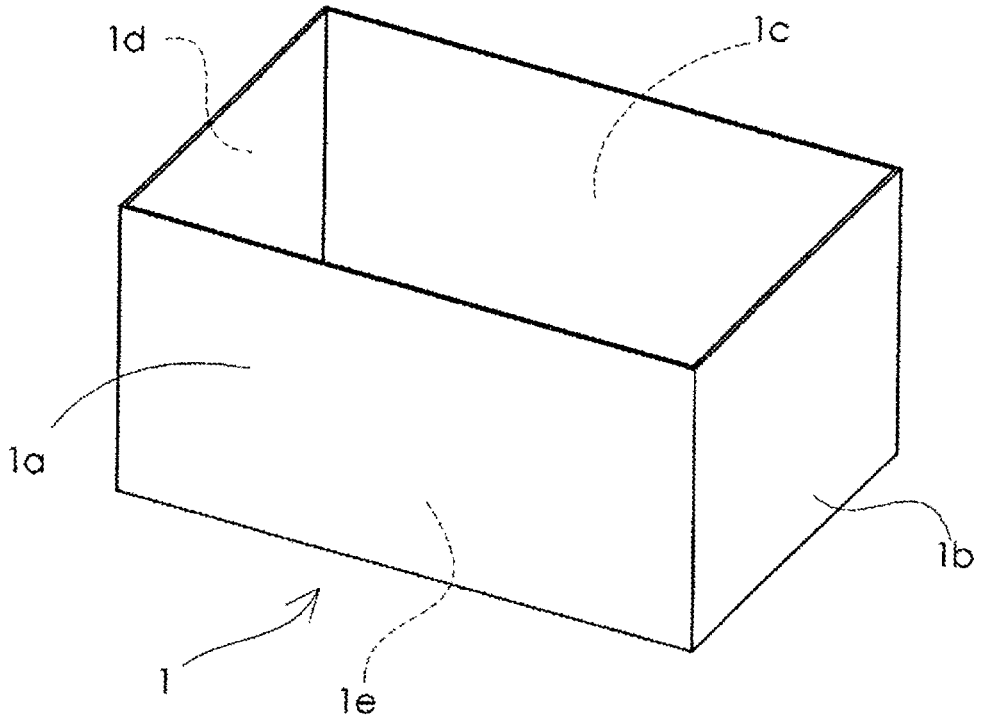
FIG. 1 is an isometric view of an empty box usable for the application of the method and of the machine according to the invention.

FIG. 1 of the attached drawings shows a box 1 which consists of a bottom 1*e* and sidewalls 1*a*, 1*b*, 1*c* and 1*d*.

According to the example shown, the bottom has a rectangular shape so that the box has the shape of a rectangular parallelepiped, whereas, according to this example, the sidewalls 1*a* and 1*c* are parallel to the length of the box 1 and that the sidewalls 1*b* and 1*d* are parallel to the width of the box.

It is emphasized that the bottom and the sidewalls could have a different shape, for example a square or generally square or rectangular shape with cut corners.

As indicated, this box 1 may be made of various flexible materials and possess the rigidity which this type of article currently presents, such as corrugated board, solid fiber or any other equivalent material in the form of flexible sheets.

Figure 2:
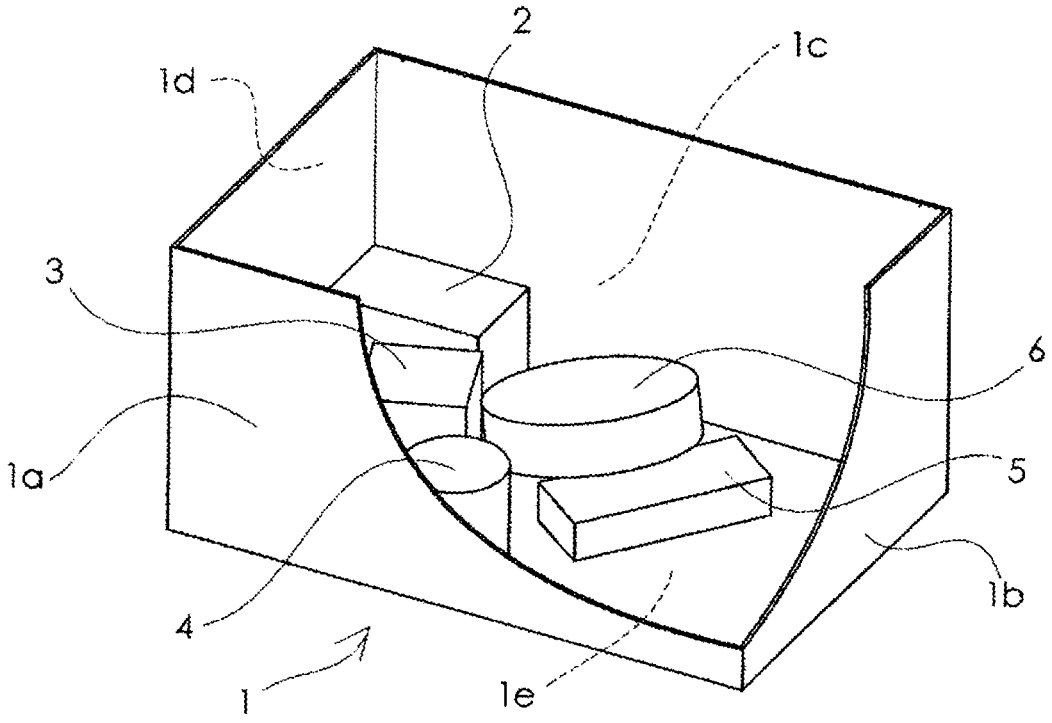
FIG. 2 is an isometric view with a cutaway of a box of the same type, filled with a certain number of objects of varied shape and dimensions.

FIG. 2 shows box 1, consisting of the bottom 1*e* and sidewalls 1*a*, 1*b*, 1*c* and 1*d*, in which are placed a certain number of items 2, 3, 4, 5 and 6 of various shapes and dimensions. The items may be of any number and size, just as their arrangement in the box may be of any sort. The items may be stacked on top of each other, if necessary. In order to justify and to authorize the treatment of the box by the machine of the invention, the height of the stack of objects must be substantially less than the height of the box. If the height of the objects is likely to be, for certain boxes, substantially equal or even greater than the height of the box, these so-called "full" boxes will not be entered in the machine or a special operating mode of the machine will be provided, for which these boxes will be able to pass through the machine without undergoing the main phases of the operating cycle of the machine.

It should be noted however that the innovating result offered by the machine is that it becomes possible to fix objects where one or more present such a height that the distance between the high point of said objects and the height of the box 1 is greater than the half-width of said box.

Figure 3:
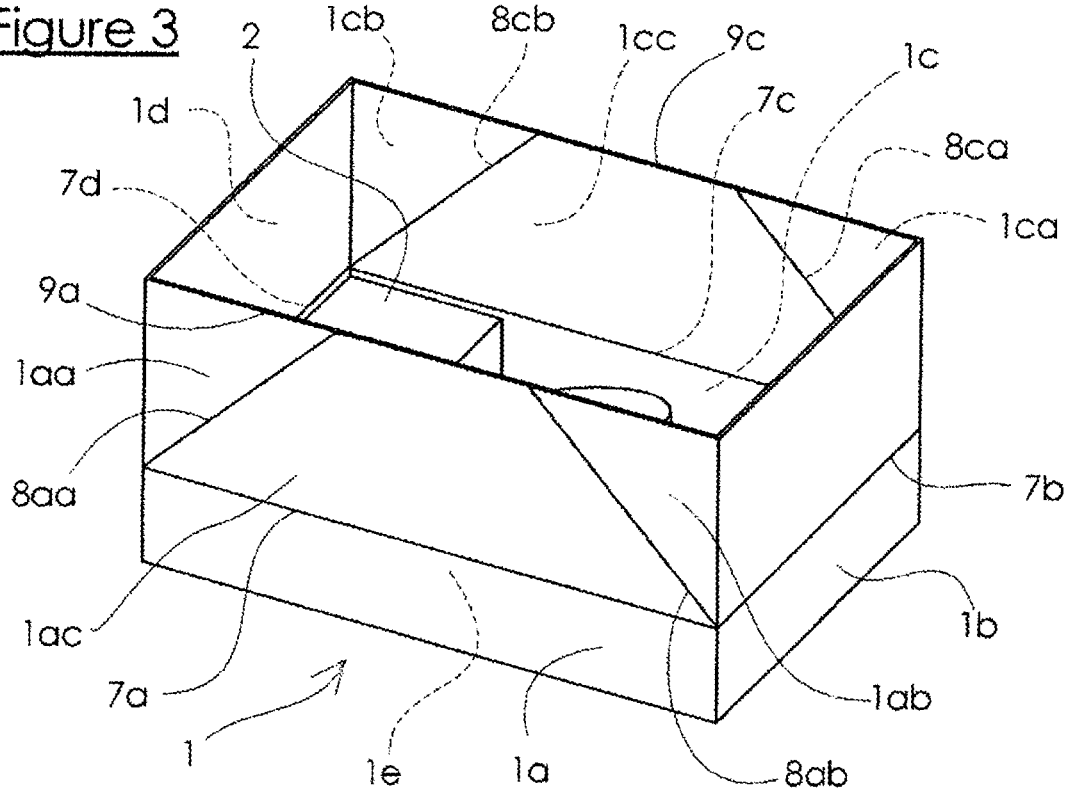
FIG. 3 is an isometric view of the box after execution of the first phases of the operating cycle of the machine.

FIG. 3 shows said box 1 after execution of the first phases of the operating cycle of the machine.

One sees on this figure the horizontal scores 7*a*, 7*b*, 7*c* and 7*d* made on each of the sidewalls 1*a*, 1*b*, 1*c* and 1*d*. Said horizontal scores 7*a*, 7*b*, 7*c* and 7*d* are made in a horizontal plane located substantially at the level of the top of the stack of objects, that is to say at the level of the upper face of object 2.

One also sees the oblique scores 8*aa* and 8*ab* made in the high part of the wall 1*a* and the oblique scores 8*ca* and 8*cb* made in the high part of wall 1*c*. The oblique score 8*aa* has one end located at one of the ends of said horizontal score 7*a*, while the oblique score 8*ab* has one end located at the other end of said horizontal score 7*a*. On the other hand, said oblique score 8*ca* has one end located at one of the ends of said horizontal score 7*c*, while the oblique score 8*cb* has one end located at the other end of said horizontal score 7*c*. Each of said oblique scores 8*aa*, 8*ab*, 8*ca* and 8*cb* forms an angle substantially equal to 45° with the horizontal plane, that is to say with the longitudinal scores 7*a* or 7*c*.

The horizontal score 7*a* and the oblique scores 8*aa* and 8*ab* delimit three flaps 1*aa*, 1*ab* and 1*ac* which form the high part of the wall 1*a*, whereas the horizontal score 7*c* and the oblique scores 8*ca* and 8*cb* delimit also three flaps 1*ca*, 1*cb* and 1*cc* on the high part of the wall 1*c*.

Also shown on FIG. 3 is the upper ridge or upper edge 9*a* of the wall 1*a* and the upper ridge or upper edge 9*c* of the wall 1*c*. It is clear that the distance between the horizontal 7*a* and the upper ridge 9*a* is equal to the distance between the horizontal score 7*c* and the upper ridge 9*c* and that each of these two distances is substantially greater than the half-width of the box which is itself equal to the distance between said sidewalls 1*a* and 1*c*.

Figure 4:
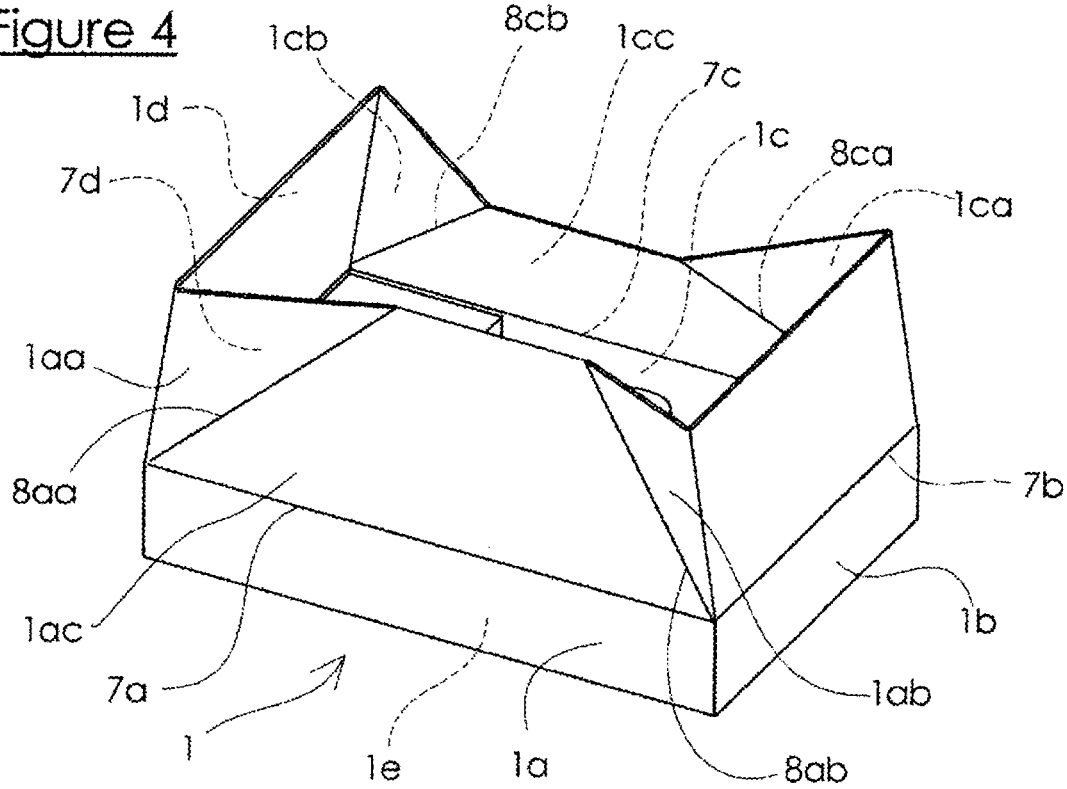
FIG. 4 is an isometric view of the box after execution of other phases of the operating cycle of the machine.

FIG. 4 shows said box 1 at a later stage of production of the operating cycle of the machine. Visible on this figure are the high parts of said sidewalls 1*a*, 1*b*, 1*c*, and 1*d* as they are being folded back toward the center of said box 1 by swiveling around the horizontal scores 7*a*, 7*b*, 7*c*, 7*d*: the high part of said wall 1*a* pivots around said horizontal score 7*a*, the high part of said wall 1*b* pivots around said horizontal score 7*b*, the high part of said wall 1*c* pivots around said horizontal score 7*c* and the high part of said wall 1*d* pivots around said horizontal score 7*d*, said horizontal scores constituting the folding lines.

It becomes clear that at the end of the folding movement, the pivoting angle of the high parts of said sidewalls around said horizontal scores will be approximately 90° when said high parts will have been brought into a substantially horizontal plane.

This figure also shows that the various flats separated by the oblique scores are also and simultaneously folded back on top of each other by pivoting around said oblique scores: flap 1*aa* is folded over flap 1*ac* by pivoting around the oblique score 8*aa*, flap 1*ab* is folded over flap 1*ac* by pivoting around the oblique score 8*ab*, flap 1*ca* is folded over flap 1*cc* by pivoting around the oblique score 8*ca* and finally flap 1*cb* is folded over flap 1*cc* by pivoting around the oblique score 8*cb*. It is clear that at the end of the movement the pivoting angle of said flaps between them will be approximately 180° when said flaps will have been brought into a substantially horizontal plane.

The high part of the sidewall 1*a* formed by flaps 1*aa*, 1*ac* and 1*ab* and the high part of said wall 1*c* constituted by the flaps 1*cb*, 1*cc*, and 1*ca* thus constitute, respectively, longitudinal flaps.

Figure 5:
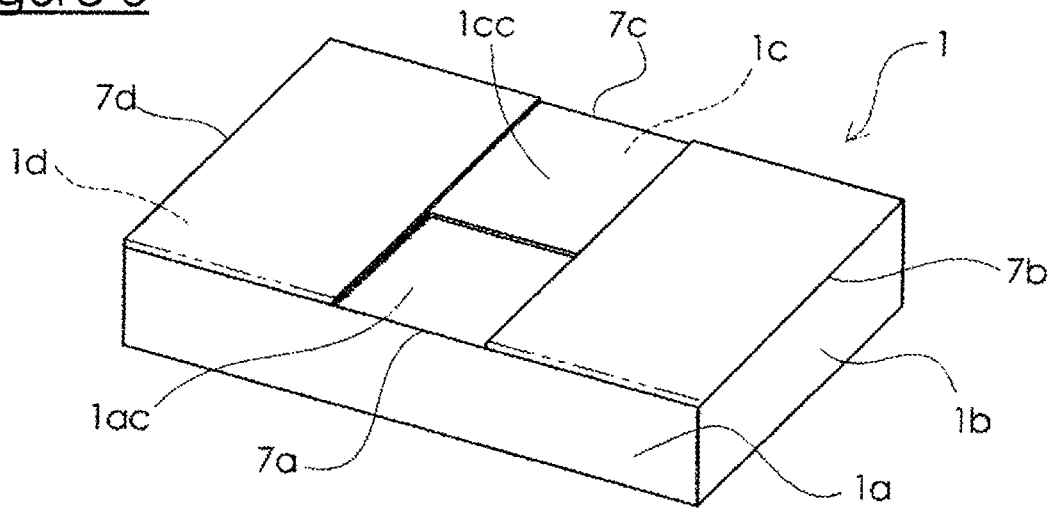
FIG. 5 is an isometric view of the box after execution of the complete operating cycle of the machine.

FIG. 5 shows the box 1 as it leaves the machine, after complete folding of the high parts of said sidewalls 1*a*, 1*b*, 1*c* and 1*d*, so that said folded high parts find themselves in a substantially horizontal plane located at the level of said horizontal scores 7*a*, 7*b*, 7*c* and 7*d*, i.e., substantially at the level of the top of the stack of objects previously placed inside said box 1 the height of which is such that the distance between said top and the height of said box and the top of said box 1 of the stack of objects previously placed in said box 1 is greater than the half-width of said box. It is clear that in order to obtain this result the high part of the wall 1*c* has passed above the high part of the wall 1*a*, during the folding phase of said walls and one sees, on FIG. 5, that the central flap 1*cc* of the high part of said wall 1*c*, folded in a horizontal plane, is overlaying the central flap 1*ac* of the folded high part of said wall 1*a*, over a part of its surface. The horizontal scores 7*a*, 7*b*, 7*c*, 7*d* and the oblique scores 8*aa*, 8*ab*, 8*ca*, and 8*cb* can be made by means of the machine described in the WO-2006/053889 document.

Figure 6:
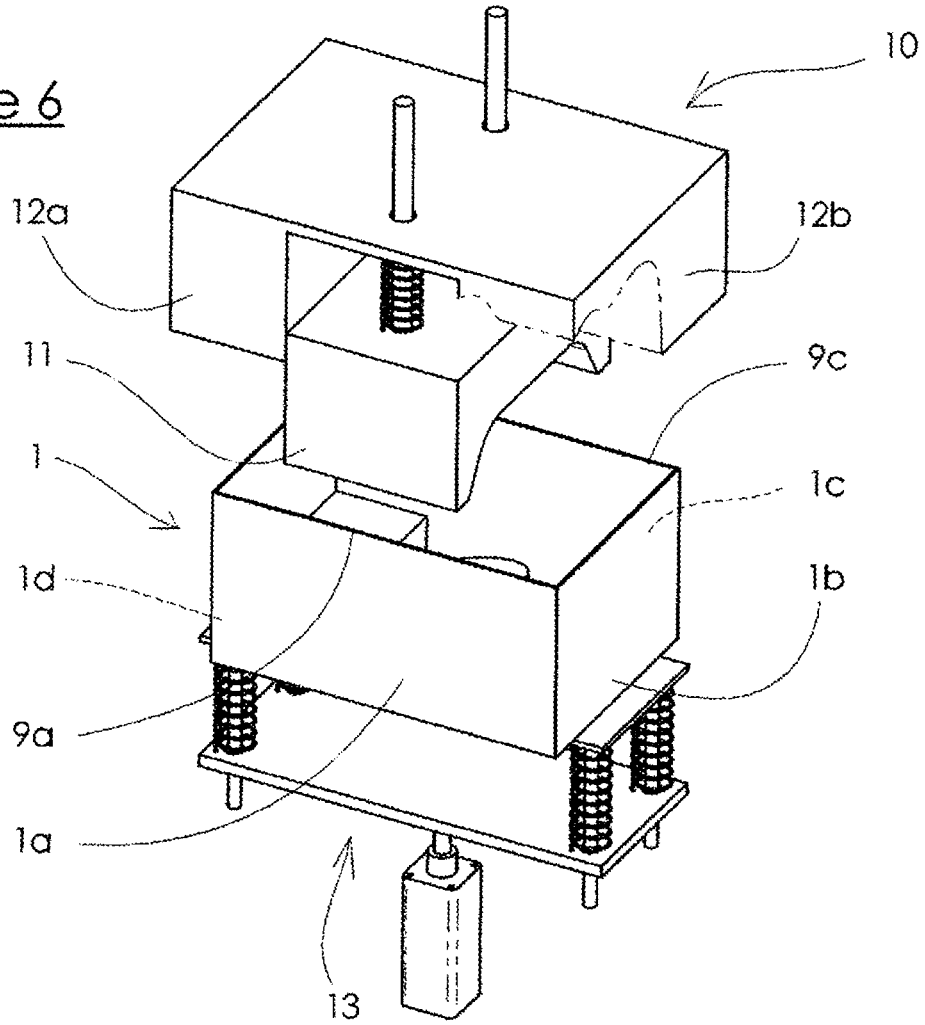
FIG. 6 is an isometric view of a part of the machine according to the invention.

On FIG. 6, only the folding station of the upper parts of the sidewalls of the box are shown, (this station being) positioned after the scoring station, as the present invention concerns only said folding station of said high parts ensuring the closure of the box.

This figure shows in particular the die 10 and the lift 13 which are used to perform the folding of the high parts of the sidewalls of said box 1.

This station includes also a diverter 11 the lower part of which features two pressing devices 12*a*, 12*b* presenting each a concave cam profile which acts, in a first phase, during the rise of said lift 13, on the upper ridges 9*a* and 9*c* of the sidewalls 1*a* and 1*c* of box 1 which are parallel to the length of box 1 positioned on said lift, by exerting on them a force with a horizontal component which tends to fold the high parts of said sidewalls 1*a* and 1*c* toward the center of said box 1.

It is clear that said ridges 9*a* and 9*c* have a tendency to come together under the action of said diverter 11.

It is also clear that the folding of the high parts of the sidewalls 1*a* and 1*c*, in this first phase, leads simultaneously to a folding toward the center of the box 1 of the high parts of the sidewalls 1*b* and 1*d* of said box which are parallel to the width of said box and with which they are connected at the level of the vertical ridges of the box.

This figure shows also the two pressing devices 12*a* and 12*b*. FIG. 6 presents a cutaway view of the pressing device 12*b*, so as to afford a good view of the diverter 11; the shape of the pressing device 12*b* is identical to that of the pressing device 12*a* and both have a lower face that is substantially plane. Said pressing devices 12*a* and 12*b* act, in a second phase, during the rising movement of said lift 20, on the high parts of said sidewalls 1*b* and 1*d* by exerting on them a vertical force which allows folding them back completely so as to bring them into a horizontal plane located substantially at the level of the top of the stack of objects.

It is clear that the folding of the high parts of the sidewalls 1*b* and 1*d*, in this second phase, leads simultaneously to a folding back, toward the center of said box 1, of the high parts of the sidewalls 1*a* and 1*c* with which they are connected at the level of the vertical ridges of said box 1, in such a manner that these are also brought into the horizontal plane located substantially at the level of the top of the stack of objects.

The high parts of the longitudinal sidewalls 1*a*, 1*c* of the box 1 have a height greater than the half-width of said box, so that the upper ridges 9*a*, 9*c* of the walls 1*a*, 1*c* could interfere with each other during the folding phase of the high parts of said walls. This method and the machine according to the invention make it possible to eliminate this problem by enabling a complete folding back of these high parts without having the upper ridges 9*a*, 9*c* of the walls 1*a*, 1*c* interfere with each other during this phase of folding.

The method according to the invention is particularly remarkable in that the horizontal scores 7*a*, 7*b*, 7*c* and 7*d* are performed at a height substantially equal to that of the top of said stack of objects and so that the distance between said top and the upper part of the box is greater than the half-width of the box, and in that, during the phase of simultaneous folding of the high parts of the two sidewalls parallel to the length of said box toward its center, and before the upper ridges or edges of said upper parts meet, one differentiates the inclination angles of said high parts, one in relation to the other, so that, when said high parts meet, the upper edge of one of said high parts will cover the upper edge of the other high part, said high parts sliding one on top of the other during their final folding phase.

According to a preferred implementation, during the simultaneous folding back of the high parts of the sidewalls 1*a*, 1*c* parallel to the length of the box, the inclination angle of at least one of said high parts is modified, or the inclination angle of both high parts.

According to an advantageous implementation, during the folding back phase of the high parts of side walls 1*a*, 1*c* parallel to the length of the box 1, the upper ridge 9*a* of the high part of one of said sidewalls parallel to the length of the box is first of all deflected downward by a deflector 14 and that simultaneously the upper ridge 9*c* of the high part of the other sidewall parallel to the length of the box is deflected upward by said deflector, then said deflector retracts under the push of at least one of said ridges, so that said ridges do not interfere with each other and that the central flaps 1*ac*, 1*cc* of the high parts of said sidewalls parallel to the length of the box then be folded back at an angle substantially equal to 90° and partially cover each other in a substantially horizontal plane at the end of the folding process.

On the other hand, the machine according to the invention is remarkable in that it comprises means to perform said horizontal scores 7*a*, 7*b*, 7*c* and 7*d* at a height substantially equal to that of the top of said stack of objects and so that the distance between said top and the height of the box is greater than the half-width of said box, and in that it features means 14 allowing, during the simultaneous folding back of the high parts of the two sidewalls 1*a*, 1*c* parallel to the length of the box toward the center of the box and before the upper ridges or edges 9*a*, 9*c* of said high parts meet, to differentiate the inclination angles of said high parts, so that when the latter meet, the upper ridge or edge 9*a* or 9*c* of one of the high parts passes above the upper ridge or edge 9*c* or 9*a* of the other high part, said high parts sliding on top of each other during the final phase of the folding back of the latter.

According to a preferred implementation, the machine features means to deflect downward the upper ridge 9*a* of the high part of one 1*a* of the side walls parallel to the length of the box, and means 14*b* to simultaneously deflect upward the upper ridge 9*c* of the high part of the other 1*c* of the sidewalls parallel to the length of the box during the folding back of the high parts of said sidewalls parallel to the length of the box.

According to another preferred implementation, said means of downward and upward deflection of the upper ridges 9*a*, 9*b* of the high parts of sidewalls 1*a*, 1*c* parallel to the length of the box, are constituted by a swiveling deflector 14 placed on the trajectory of swivel of said high parts toward the center of the box, of the upper ridges or edges 9*a*, 9*c* of said high parts.

Figure 7:
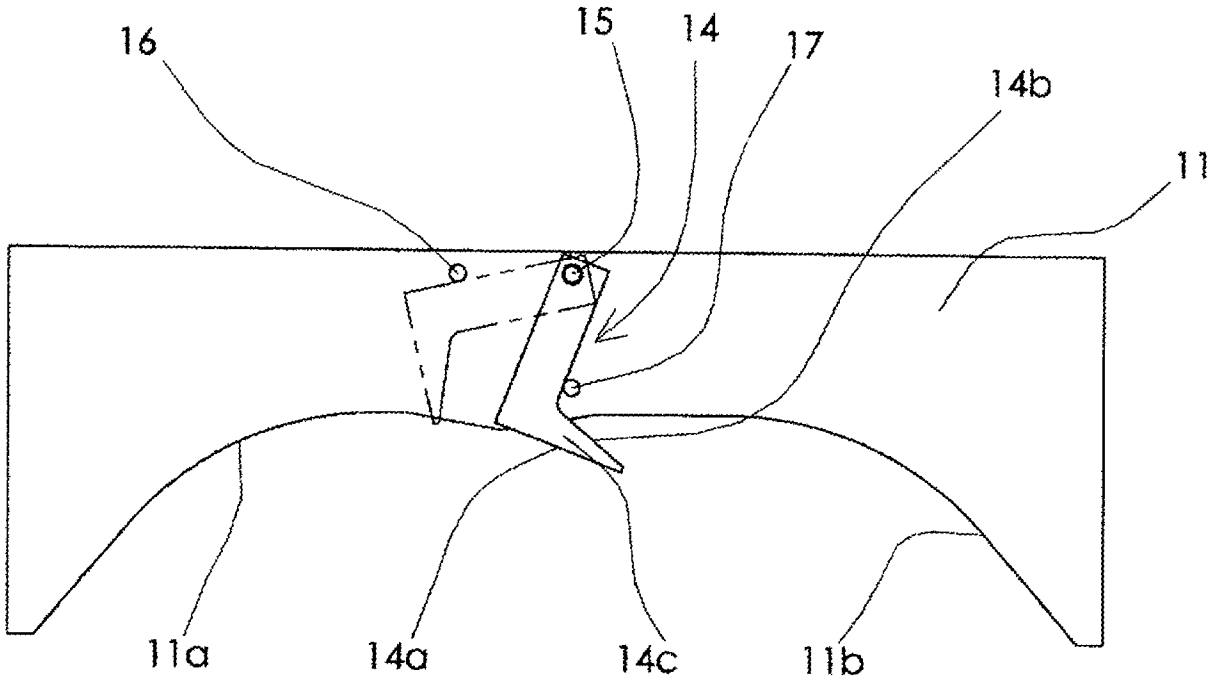
FIG. 7 is a detailed schematic cutaway view, of a pivoting deflector for deflecting the high parts of the sidewalls parallel to the length of the box, while said high parts are being folded toward the center of said box.

FIG. 7 is a section view of said diverter 11. This figure shows that said diverter incorporates a deflector 14 which is mobile in rotation around a rotational axis 15. The amplitude of the rotational movement of said deflector 14 is limited by the stops 16 and 17. FIG. 7 shows that said deflector presents an L-shaped profile and features, in its low part, a zone or wing 14*c* with a triangular section and which features itself two active faces, namely a lower face 14*a* and an upper face 14*b*.

FIGS. 8 to 13 are section views of said box 1 and of said diverter 11, at different successive phases of folding of the high part of said sidewalls 1*a* and 1*c* of said box 1, as said lift 13 rises.

Figure 8:
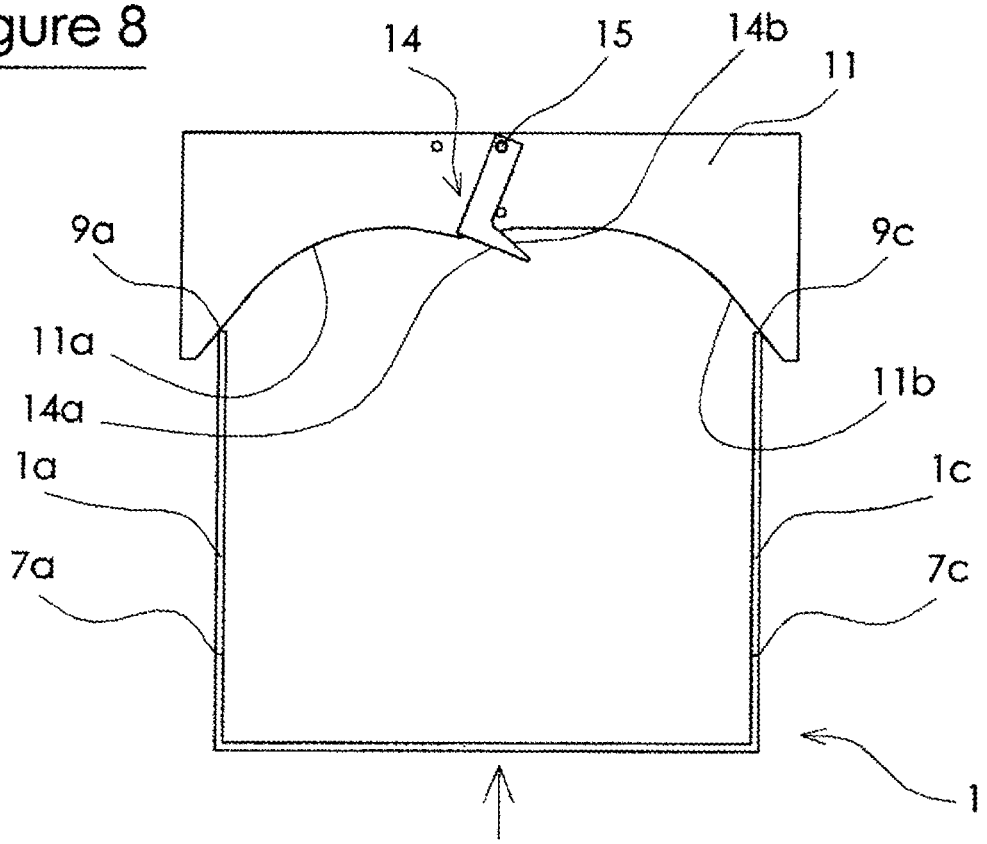
FIGS. 8 to 13 are cross section views of the box and the part of the machine shown in FIG. 7, illustrating six successive steps of the operating cycle of the folding method of the high parts of the sidewalls parallel to the length of the box.

FIG. 8 shows that the ridges 9*a* and 9*c* come first into contact with the lower faces 11*a* and 11*b* of said diverter 11.

Figure 9:
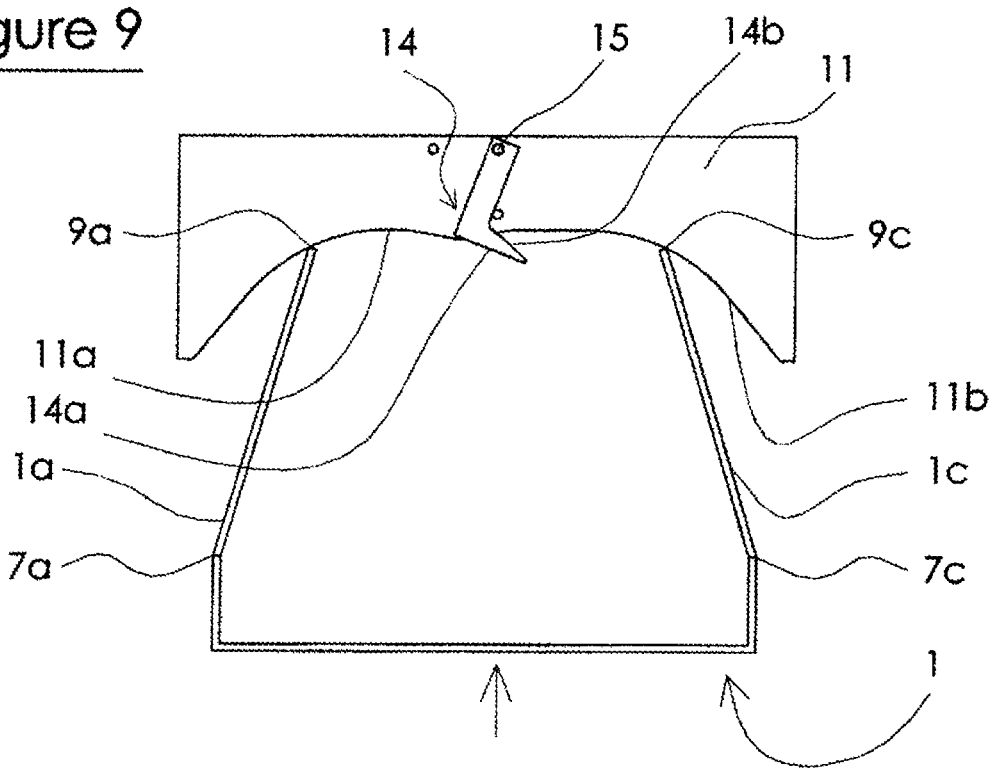

FIG. 9 then shows that, under the effect of the horizontal component of the effort exerted by the diverter 11 on said ridges 9*a* and 9*b*, the high parts of the sidewalls 1*a* and 1*c* are folded back toward the center of said box 1 in a rotational movement around said horizontal scores 7*a* and 7*c*.

Figure 10:
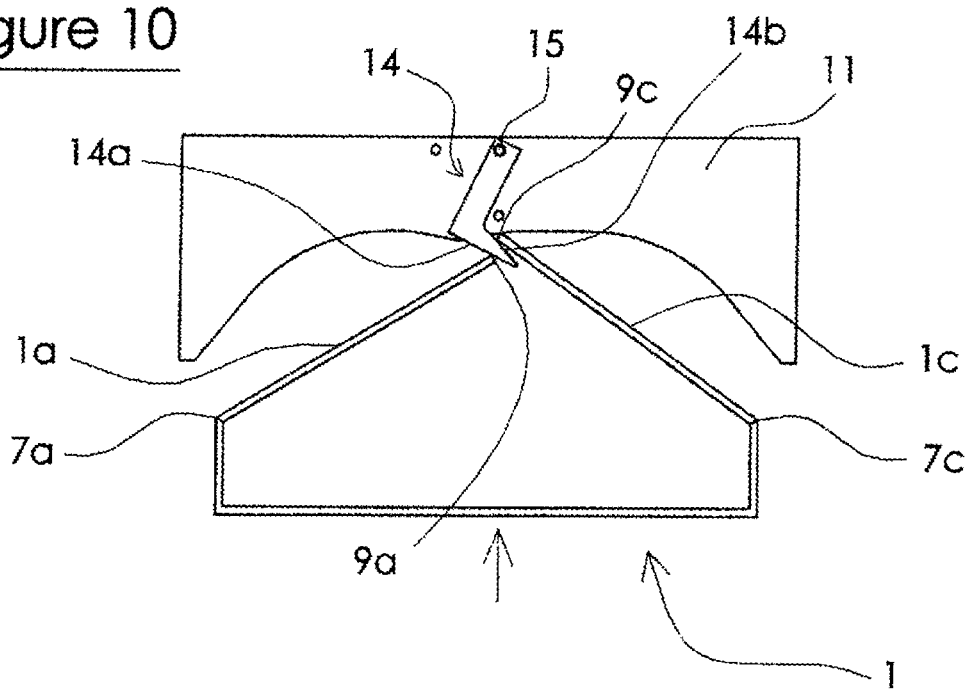

FIG. 10 shows that said ridges 9*a* and 9*c* then come into contact with said deflector 14, the ridge 9*a* coming into contact with the lower face 14*a* and the ridge 9*c* coming into contact with the upper face 14*b* of said deflector. It is clear that the ridge 9*a* is diverted downward just like the high part of the sidewall 1*a* and then loses contact with said diverter 11, whereas the ridge 9*c* is diverted upward, just like the high part of sidewall 1*c* and thus keeps in contact with said diverter 11.

Figure 11:
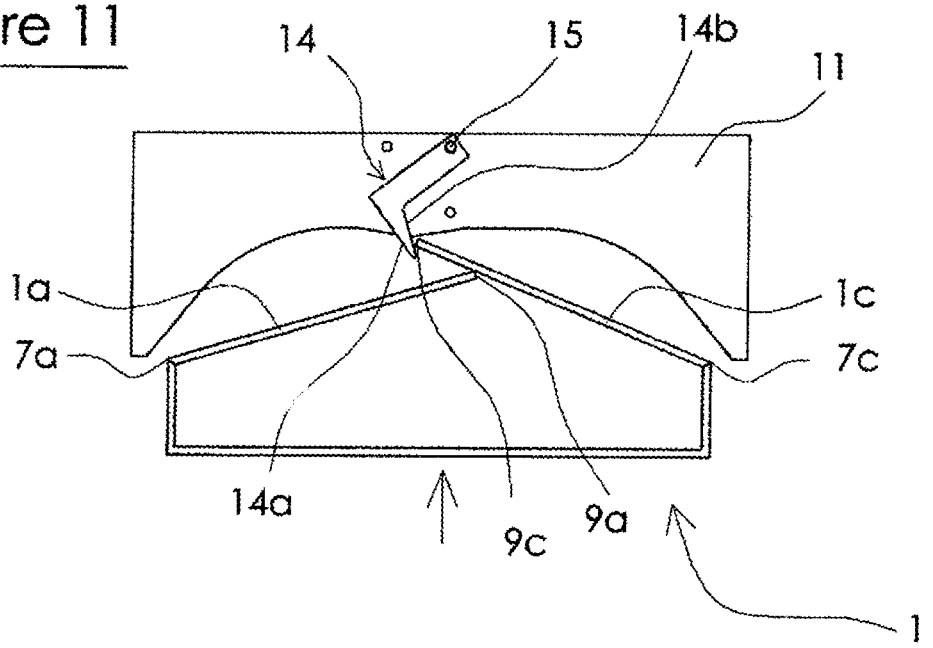

FIG. 11 shows that, following the folding movement, said ridge 9*a* then loses contact with the lower face 14*a* of said deflector 14, to come into contact with the underside of the folded upper part of said sidewall 1*c*, and that, at the same time, said ridge 9*c* exerts a force on said deflector 14, a force which tends to make said deflector swivel around its rotational axis 15 until said deflector will be completely retracted.

Figure 12:
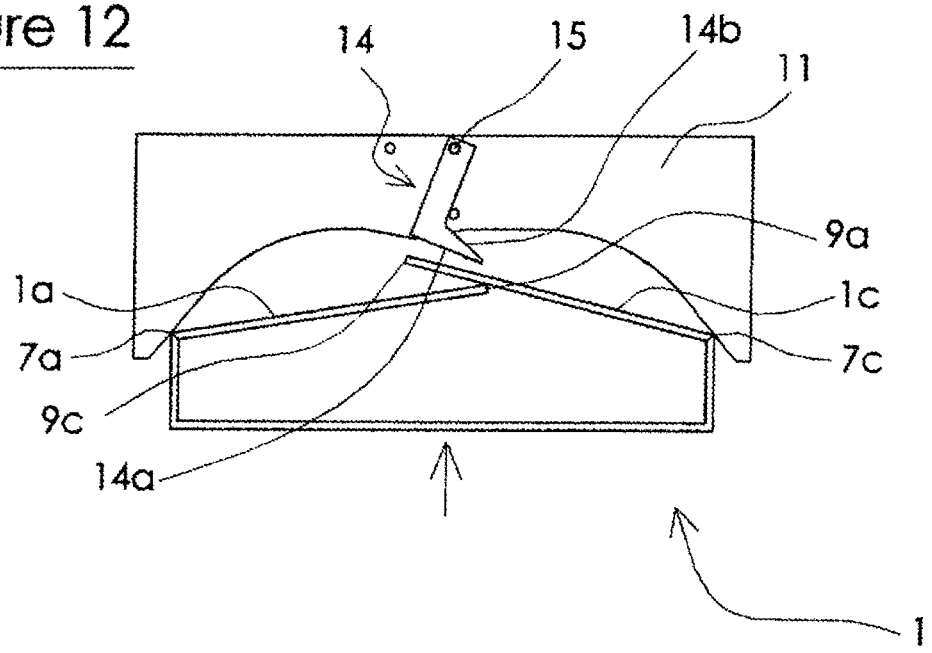

FIG. 12 shows that, in an ulterior phase of the folding movement, said ridge 9*c* has also lost contact with said deflector 14 and we have previously seen that the action of said pressing devices 12*a* and 12*b* then causes the folding of the upper part of said sidewalls 1*b* and 1*d* which leads to the folding of the upper part of said sidewall 1*c*, and also to that of the upper part of said sidewall 1*a*, thanks to the action of the underside of said wall 1*c* on said ridge 9*a*.

Figure 13:
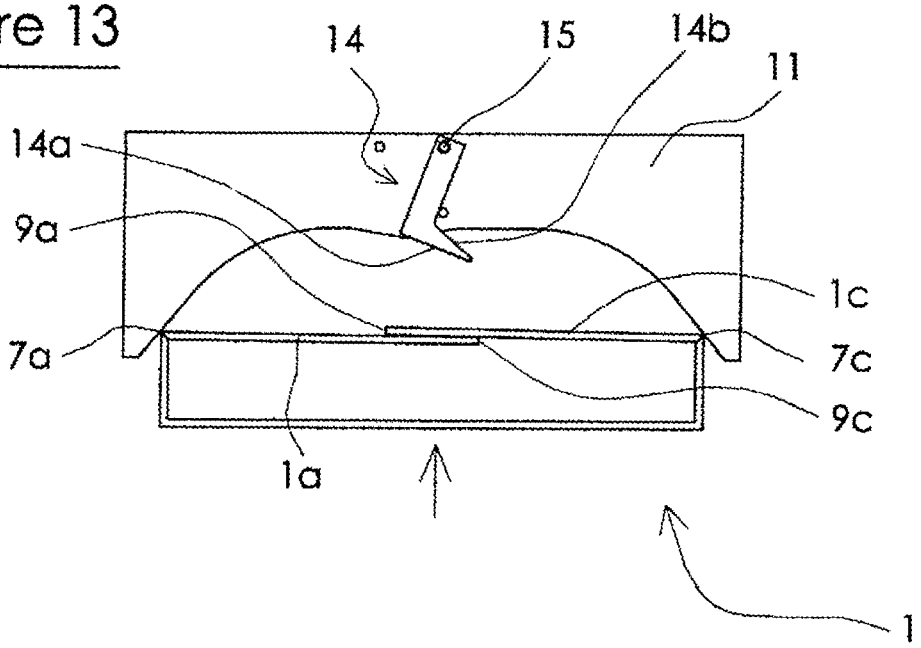

FIG. 13 shows said box 1 after complete folding of the upper parts of said sidewalls 1*a* and 1*c*. We know that this complete folding was made possible thanks to the action of said pressing devices 12*a* and 12*b* as described previously. We see that the folded upper parts of said sidewalls 1*a* and 1*c* find themselves in a substantially horizontal plane and that the folded upper part of said wall 1*c* is superposed on the folded upper part of said sidewall 1*a* over a part of its surface. We also see said deflector 14 which has resumed its initial position under the action of its own weight or for example under the action of a spring or another element not shown on FIG. 13.

It is emphasized that it is possible to obtain a differentiation of the swivel angles of the upper parts of the sidewalls parallel to the length of the box through means other than a swiveling deflector. It is in fact possible to differentiate the contact surfaces (11*a*, 11*b*) of the diverter 11, either with respect to their shape, or with respect to their height. It is even possible to envisage using only one of these contact surfaces for this purpose.

Figure 14:
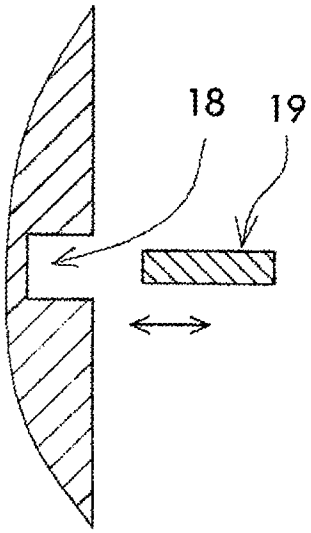
FIGS. 14 to 16 are detail and section views of a part of the machine which illustrate various possibilities to implement the method and to produce the machine according to the invention.
Figure 15:
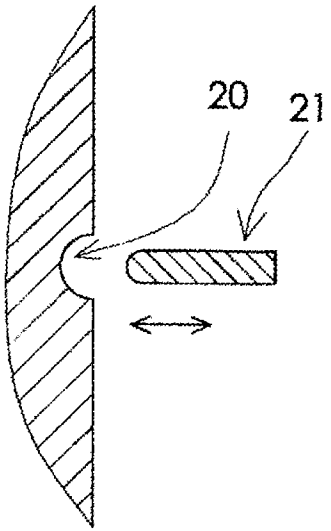
Figure 16:
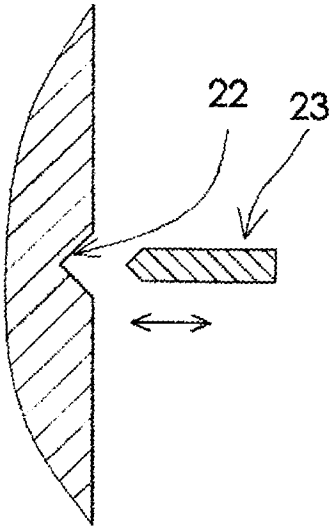

FIGS. 14 to 16 are section views which illustrate different possibilities of creating a score of the type of those which are made on said box 1 for the implementation of the method according to the invention.

FIG. 14 shows a score 18 with a square or rectangular section and a tool 19 the end of which also has a square or rectangular section. It is clear that in order to obtain a score of the type of those which are made on said box for the implementation of the method according to the invention, it is advisable to position the material area of said box where the scoring is to be made between said groove 18 and said tool 19, then to bring said tool close to said groove by crushing said material zone under the effect of compressive stress. It is clear that the fact that the end section of said tool 19 is complementary to that of said groove 18 allows introducing said tool at least partially into said groove under the effect of compressive stress and thus to obtain good compression of the material, characterized by a significant reduction of its thickness along a segment of material of small width.

FIGS. 15 and 16 show two other possibilities of producing said scoring.

FIG. 15 shows a groove 20 with a semi-circular section and a tool 21 the end of which also has a semi-circular section. FIG. 16 shows a groove 22 with a triangular section and a tool 23 the end of which also has a triangular section. So said tools 21 and 23 have one end with a section that is substantially complementary of said grooves 20 and 22 respectively and may also be used in association with said grooves 20 and 22 respectively to obtain said scoring by following the same operating mode as with said groove 18 and said tool 19.

Figure 17:
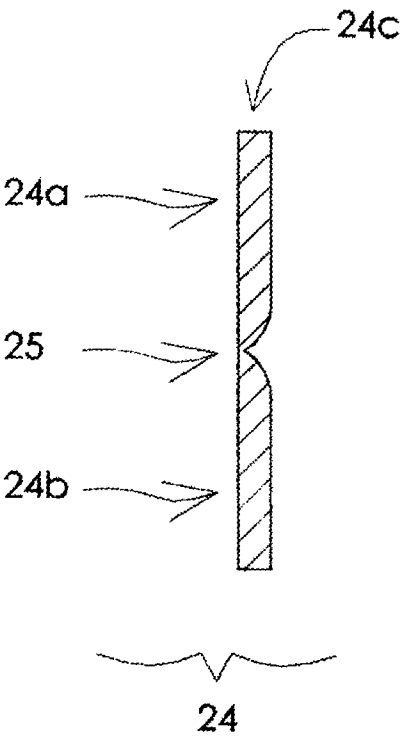
FIGS. 17 to 19 are detail and section views of a flank of flexible material of the type used for manufacturing the box.
Figure 18:
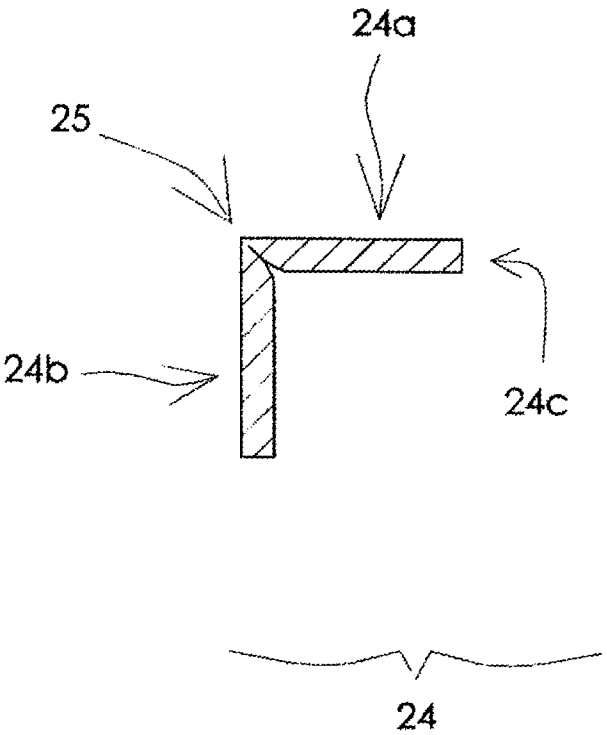
Figure 19:
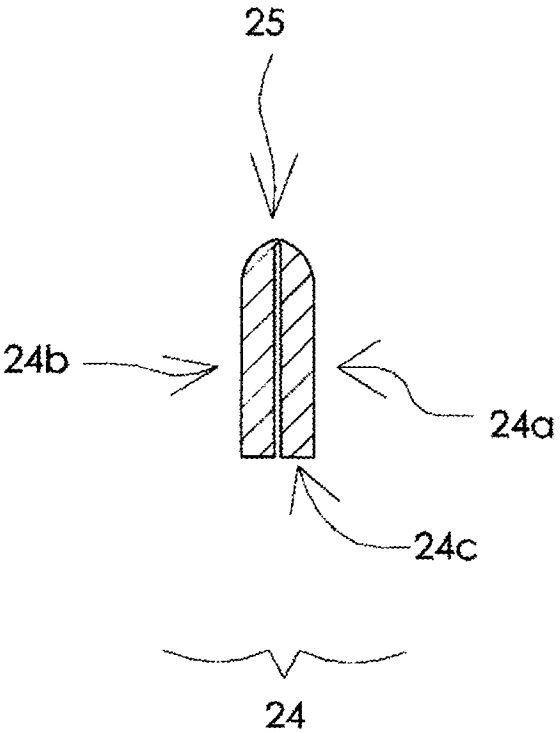

FIGS. 17 to 19 are section views of a material flank 24 of flexible material of the type of those used for manufacturing said box 1.

FIG. 17 shows said flank in vertical position. Visible on said flank 24 is a score 25 of the type of those which are made on said box for the implementation of the method according to the invention. One sees that said scoring 25 has the effect of significantly reducing the thickness of said flank 24 locally, along a segment perpendicular to the cutting plane, and one understands that this results in facilitating the folding of said flank at the level of said segment. One also sees that said scoring 25 delimits the border between the flank part 24*a* and the flank part 24*b* of said flank 24.

FIG. 18 shows said flank 24 after folding, around said score 25 and at an angle substantially equal to 90°, of the flank part 24*a* relative to flank part 24*b*, so as to bring flank part 24*a* into a substantially horizontal plane. One understands that the elasticity of the material generates stresses in the area of said scoring 25 which are opposed to this folding and which tend to bring said flank part 24*a* back to its initial position. It is also clear that, if said flank part 24*b* is kept in a fixed position, it is impossible to move the end 24*c* of said flank part 24*a* horizontally without compressing or stretching the material of said flank 24.

FIG. 19 shows said flank 24 after folding of flank part 24*a*, at an angle substantially equal to 180°, relative to flank part 24*b* so as to bring flank part 24*a* into a substantially vertical plane. One understands that the elasticity of the material generates stresses in the area of said scoring 25 which are opposed to this folding and which tend to bring said flank part 24*a* back to its initial position. It is also clear that, if said flank part 24*b* is kept in a fixed position, it is impossible to move the end 24*c* of said flank part 24*a* vertically, without compressing or stretching the material of said flank 24.

Figure 20:
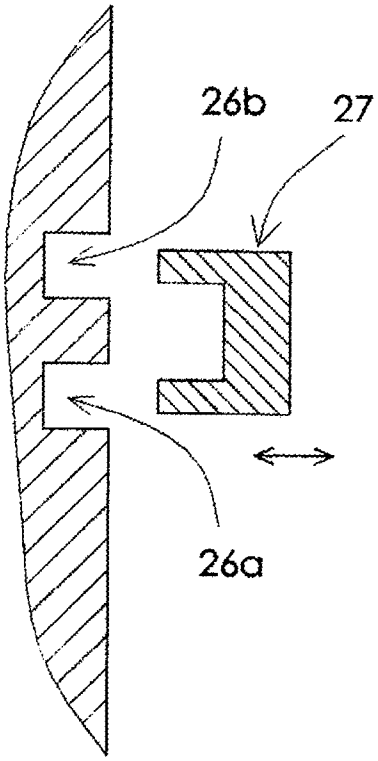
FIG. 20 is a detail and section view of a part of the machine according to the invention.

FIG. 20 is a section view which illustrates a possibility of producing a double-score of the type of those made on said box 1 for the implementation of the method according to the invention. FIG. 20 shows two grooves 26*a* and 26*b* of square or rectangular section and one understands that said scores are substantially parallel. Also shown is a tool 27 which has two ends with square or rectangular section ends, each of these two ends being located in front of one said grooves 26*a* or 26*b*. It is clear that, in order to obtain a double-score of the type of those made on said box for the implementation of the method according to the invention, it is advisable to place the material area of said box where the double-score is to be made between said grooves 26*a* and 26*b* and said tool 27, then to move said tool to said grooves by crushing said material zone under the effect of an effort of compression. It is clear that the fact that the section of the ends of said tool 27 is complementary to that of each of said grooves 26*a* and 26*b*, makes it possible to introduce, at least partially, said tool into said grooves under the effect of compressive stress and thus to obtain a good compression of the material, characterized by a significant reduction of its thickness along two segments of material substantially parallel and close to each other. One understands also that such a double-score can also be obtained with two grooves of a semi-circular or triangular section and a tool with two ends of a semi-circular or triangular section, respectively, without the shape of said sections having any limiting character.

Figure 22:
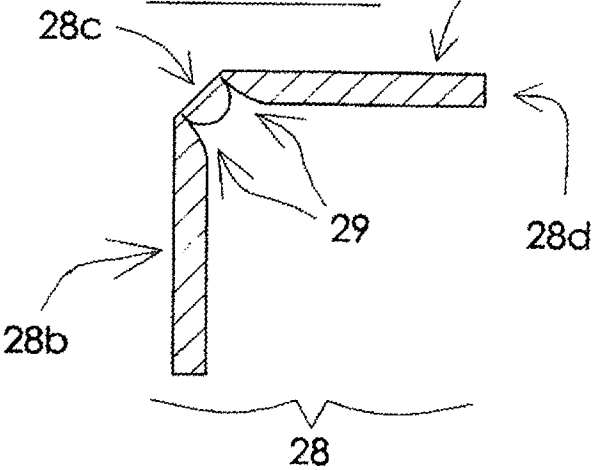
FIGS. 21 to 23 are section views of a flank of flexible material of the type used for manufacturing the box.
Figure 23:
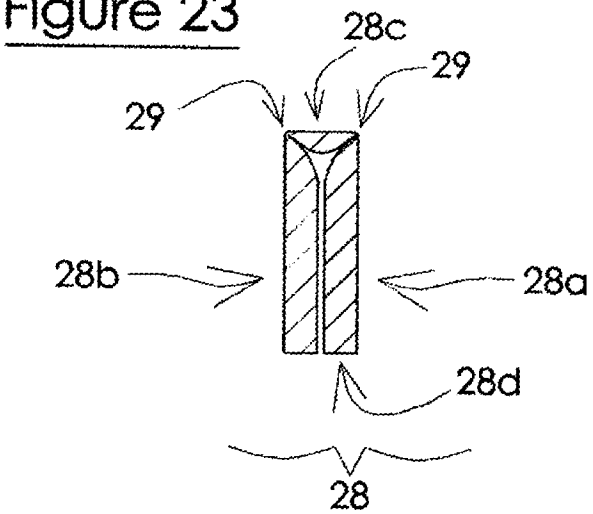
Figure 21:
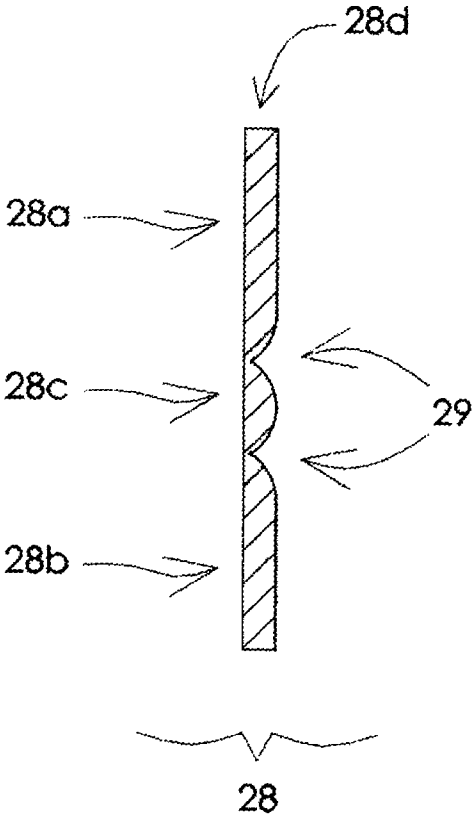

FIGS. 21 to 23 are section views of a material flank 28 of a flexible material of the type used for manufacturing said box 1.

FIG. 21 shows said flank in vertical position. On said flank 28 one sees a double-score 29 of the type of those that are made on said box for the implementation of the method according to the invention. One sees that said double-score 29 has the effect of significantly reducing the thickness of said flank 28 locally, along two segments perpendicular to the cutting plane, and one understands that this consequently facilitates the folding of said flank at the level of said segments. One also sees that the double-score 29 delimits the borders between flank part 28*a*, flank part 28*b*, and flank part 28*c* of said flank 28.

FIG. 22 shows said flank 28 after folding back at an angle substantially equal to 90° of the flank part 28*a* relative to flank part 28*b*, so as to bring flank part 28*a* in a substantially horizontal plane. One understands that, taking into account the equilibrium of the forces of elasticity; the flank part 28*c* is also folded back and forms an angle substantially equal to 45° with said flank parts 28*a* and 28*b*, respectively. One understands also that said double-score 29 reduces, compared to a single score, the stresses arising from the elasticity of the material which are opposed to said folding and tend to bring back said flank part 28*a* into its initial position. One understands also that said double-score 29 increases the number of degrees of mobility of flank part 28*a* and that, for example, if said flank part 28*b* is kept in a fixed position, it becomes possible to horizontally move the end 28*d* of said flank part 28*a*, without compressing or stretching the material of said flank 28, but by varying the angle formed by said flank part 28*c* with said flank parts 28*a* and 28*b*, respectively.

FIG. 23 shows said flank 28 after folding back flank part 28*a*, at an angle substantially equal to 180°, relative to flank part 28*b*, so as to bring it into a substantially vertical plane. One understands that, taking into account the equilibrium of the forces of elasticity, the flank part 28*c* is also folded back and forms an angle substantially equal to 90° with flank part 28*a* and flank part 28*b*, respectively. One understands also that said double-score 29 reduces, compared to a single score, the stresses arising from the elasticity of the material which are opposed to said folding and tend to bring said flank part 28*a* back into its initial position. One understands also that said double-score 29 increases the number of degrees of mobility of flank part 28*a* and that, for example, if said flank part 28*b* is kept in a fixed position, it becomes possible to vertically move the end 28*d* of said flank part 28*a*, without compressing or stretching the material of said flank 28, but by varying the angle formed by said flank part 28*c* with said flank parts 28*a* and 28*b*, respectively.

Figure 24:
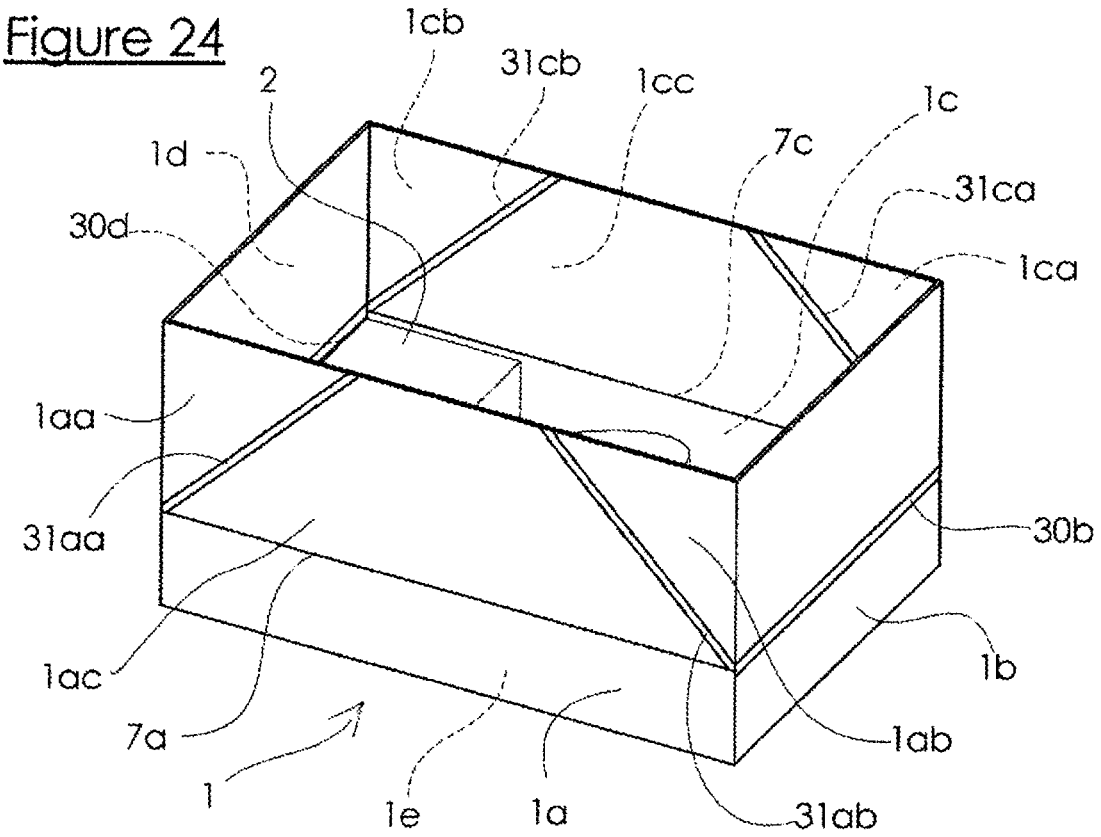
FIG. 24 is an isometric view of the box after execution of the first phases of the operating cycle of the machine.

FIG. 24 is an isometric view of the box after performing the first phases of the operating cycle of the machine according to an advantageous implementation of the method of the invention.

FIG. 24 shows the horizontal scores 7*a* and 7*c* made on the two sidewalls 1*a* and 1*c* which are parallel to the length of the box 1. Said horizontal scores 7*a* and 7*c* are made in a horizontal plane located substantially at the top level of the stack of objects.

FIG. 24 also shows the horizontal double-scores 30*b* and 30*d* made on the two sidewalls 1*b* and 1*d* which are parallel to the width of the box 1. Said horizontal double-scores 30*b* and 30*d* are also made in a horizontal plane located substantially at the top level of the stack of objects.

One also sees the oblique double-scores 31*aa* and 31*ab* made on the wall 1*a* and the oblique double-scores 31*ca* and 31*cb* made on the wall 1*c*. One sees that said oblique double-score 31*aa* has one end located at the level of one of the ends of said horizontal score 7*a*. One sees that said oblique double-score 31*ab* has one end located at the level of the other end of said double-score 7*a*. One understands that said oblique double-score 31*ca* has one end located at the level of one of the ends of said horizontal score 7*c*. One sees that said oblique double-score 31*cb* has one end located at the level of the other end of said horizontal score 7*c*. One also sees that said oblique double-scores 31*aa*, 31*ab*, 31*ca* and 31*cb* form an angle substantially equal to 45° with the horizontal plane.

One also sees that said horizontal score 7*a* and said oblique double-scores 31*aa* and 31*ab* have created three flaps 1*aa*, 1*ab* and 1*ac* on the upper part of said wall 1*a* and that said horizontal score 7*c* and said oblique double-scores 31*ca* and 31*cb* have also created three flaps 1*ca*, 1*cb*, and 1*cc* on the upper part of said wall 1*c*.

Figure 25:
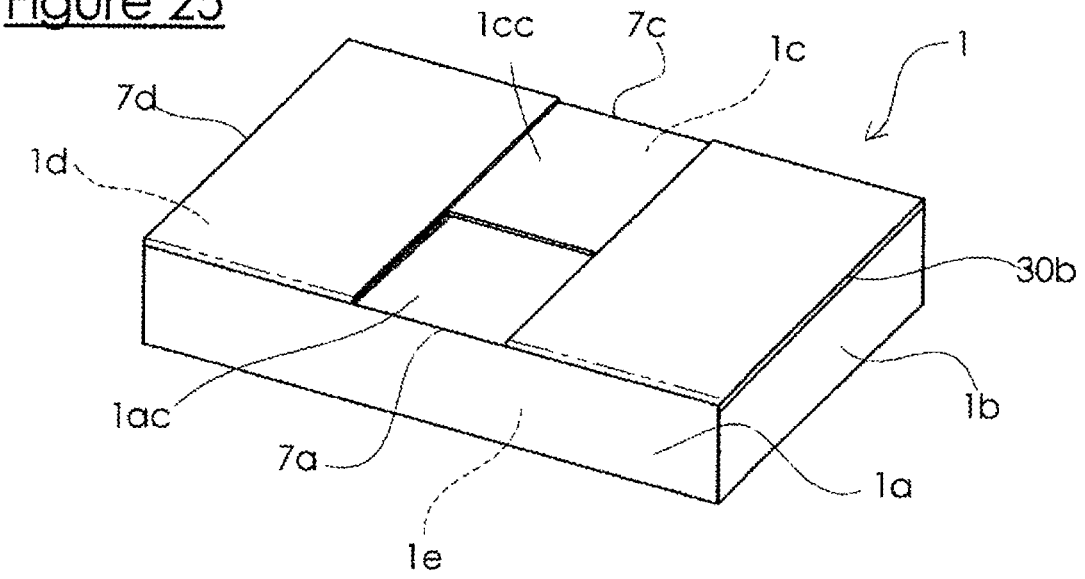
FIG. 25 is an isometric view of the box after execution of the complete operating cycle of the machine.

FIG. 25 shows said box 1 after execution of all the phases of the operating cycle of the machine according to an advantageous implementation of the method of the invention. One sees, on FIG. 25, that the upper parts of the various sidewalls 1*a*, 1*b*, 1*c* and 1*d* have been folded back in a manner to bring them into a substantially horizontal plane located at the level of said horizontal scores 7*a* and 7*c* and of said horizontal double-scores 30*b* and 30*d*, namely substantially at the level of the top of stack of objects previously placed into said box 1. One sees in particular that the upper part of said sidewalls 1*b* and 1*d*, parallel to the width of said box 1 forms an angle substantially equal to 90° with the low part of said sidewalls 1*b* and 1*d*. And one understands that the presence of said horizontal double-scores 30*b* and 30*d* allows reducing, compared to single scores, the stresses associated with to the elasticity of the material which tend to bring the upper part of said walls 1*b* and 1*d* back into vertical position.

One also understands that the different flaps 1*aa*, 1*ab*, 1*ac*, 1*ca*, 1*cb*, and 1*cc*, separated by said oblique double-scores 31*aa*, 31*ab*, 31*ca* and 31*cb*, have also been folded back on top of each other by pivoting around said oblique double-scores. One understands in particular that said flap 1*aa* is folded back over said flap 1*ac* around said oblique double-score 31*aa* and thus forms an angle substantially equal to 180° with said flap 1*ac*, that said flap 1*ca* is folded back over said flap 1*cc* by pivoting around said oblique double-score 31*ca* and thus forms an angle substantially equal to 180° with said flap 1*cc* and finally that said flap 1*cb* is folded back over said flap 1*cc* by pivoting around said oblique double-score 31*cb* and forms an angle substantially equal to 180° with said flap 1*cc*. And one understands that the presence of said oblique double-scores 31*aa*, 31*ab*, 31*ca* and 31*cb* makes it possible to reduce, compared to single oblique scores, the stresses associated with the elasticity of the material which tend to bring said flaps 1*aa*, 1*ab*, 1*ac*, 1*ca*, 1*cb* and 1*cc* into vertical position.

Figure 26:
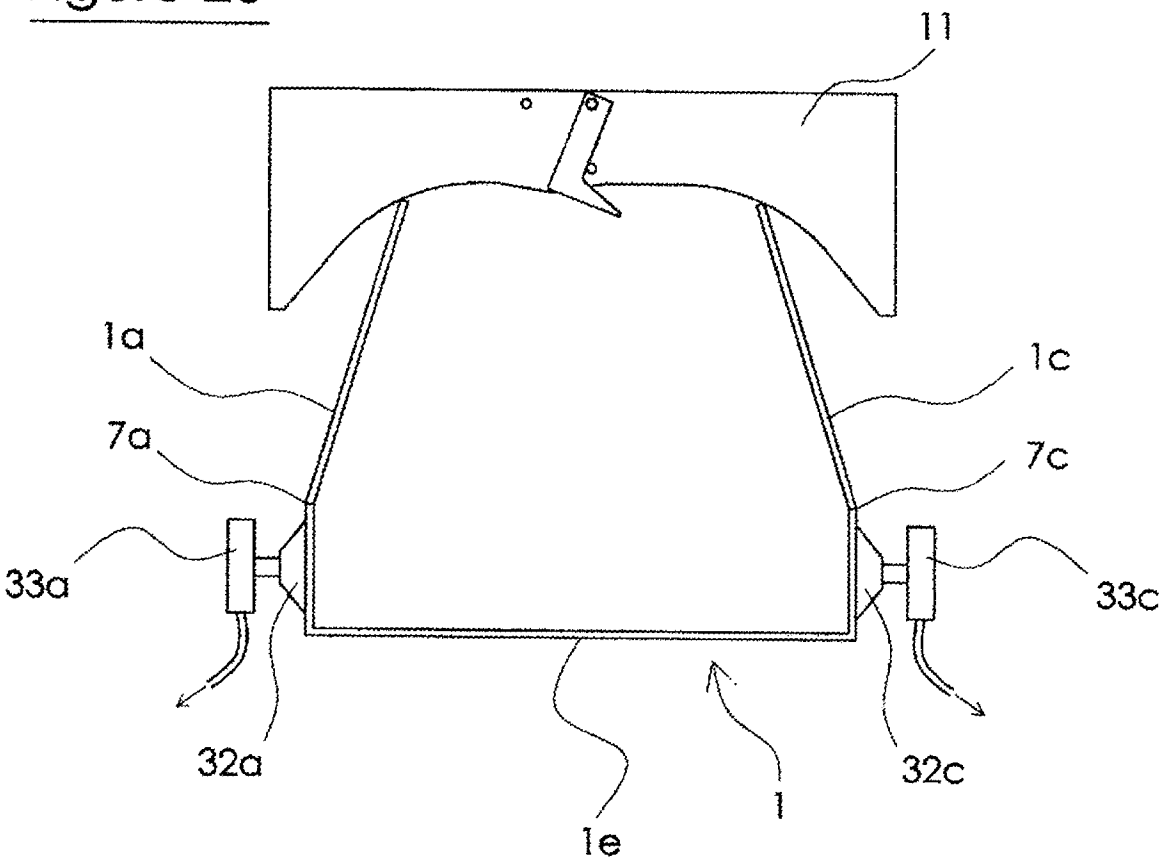
FIG. 26 is a section view of the box and a part of the machine according to the invention.

FIG. 26 is a section view of said box 1 and of said diverter 11 during the folding phase of the upper parts of said sidewalls 1*a* and 1*c* around said horizontal scores 7*a* and 7*c*, respectively. One understands that, if the distance between said horizontal scores 7*a* and 7*c* and the bottom of said box 1 is reduced, the upper part of said sidewalls 1*a* and 1*c* may well have a tendency to pivot around, respectively, the horizontal ridge which connects said wall 1*a* and said wall 1*c* with the bottom 1*e*. One sees on FIG. 26 two systems intended to keep the low part of said sidewalls 1*a* and 1*c* in vertical position. One sees the first system constituted by the suction cup 32*a* and the vacuum generator 33*a* of which one understands that it is applied against the low part of said sidewall 1*a* to keep it vertical and to force the upper part of said sidewall 1*a* to pivot around the horizontal score 7*a*. One also sees the second system constituted by the suction cup 32*a* and the vacuum generator 33*c*, of which one understands that it is applied against the low part of said sidewall 1*c* to keep it vertical and to force the upper part of said sidewall 1*c* to pivot around the horizontal score 7*c*.

The invention claimed is:

1. A method for reducing a height of a box formed of a flexible material, the box having a bottom and at least four sidewalls extending to a level of a top of a stack of objects previously placed into the box, the four sidewalls including two length sidewalls that are parallel to a length dimension of the box and two width sidewalls that are parallel to a width dimension of the box, the reduction of the height of the box being greater than a half-width of the box, the method comprising:

making a horizontal score in each of the sidewalls of the box at a height substantially equal to the top of the stack of objects so that a distance between the top of the stack of objects and a top of the box is greater than the half-width of the box;

making two oblique scores in an upper part of each of two of the length sidewalls, each of the oblique scores having one end located at a level of one end of the horizontal score and another end located at a level of an upper edge of one of the length sidewalls such that the oblique score forms an angle substantially equal to 45° to a horizontal plane;

folding the upper part of each of the length sidewalls toward a center of the box around the horizontal score at an angle substantially equal to 90° until the upper parts of the length sidewalls between the oblique angles overlap each other and are at an angle substantially equal to 180°, wherein the folding of the upper parts of the length sidewalls includes differentiating inclination angles of the upper parts of the length sidewalls before the upper edges of the length sidewalls meet so that, when the upper parts of the length sidewalls meet, the upper edge of the upper part of one of the length sidewalls covers the upper edge of the other of the length sidewalls and the upper parts of the length sidewalls slide one over the other; and folding an upper part of each of the width sidewalls toward the center of the box around the horizontal score at an angle substantially equal to 90°, wherein, prior to folding the upper part of each of the length sidewalls, the upper edges of the two length sidewalls are substantially the same distance from the bottom of the box;

wherein, during the step of folding the upper parts of the length sidewalls, the upper edge of the upper part of one of the length sidewalls is first diverted downwardly by a deflector and simultaneously the upper edge of the upper part of the other length sidewall is diverted upwardly by the deflector, the deflector retracting under a pushing force of at least one of the upper edges so that the upper edges do not interfere with each other and that center flaps of the upper part of the length sidewalls are folded back at an angle substantially equal to 90° and overlap each other partially in a substantially horizontal plane at the end of the folding.

2. The method of claim 1, wherein during the folding the upper parts of the length sidewalls, the inclination angle of at least one of the upper parts is modified.

3. The method of claim 1, further comprising:

crushing a material of the box at a bottom of a groove by a tool that has an end substantially complementary to a shape of the groove so as to make each of the horizontal scores oblique scores.

4. The method of claim 1, further comprising:

making a horizontal double-score on each of the two width sidewalls, the horizontal double-score being two parallel horizontal scores close to each other, the horizontal double-score located at a height substantially equal to the top of the stack of objects so that the distance between the top of the stack of objects and the height of the box is greater than the half-width of the box.

5. The method of claim 1, further comprising:

making two oblique double-scores on the upper part of each of the two length sidewalls, each of the two oblique double-scores being two oblique scores parallel and close to each other, each of the oblique double-scores having one end located at one end of the horizontal score and another end located at the upper edge of the length sidewall in such a manner that the oblique double-score extends at an angle substantially equal to 45° to a horizontal plane.

6. The method of claim 1, wherein a lower part of each of the two length sidewalls is kept in a horizontal orientation when the length sidewalls are folded toward the center of the box.

7. The method of claim 1, wherein, after the folding of the upper parts of the width sidewalls, the upper part of each of the width sidewalls cover overlapping portions of the length sidewalls.

8. The method of claim 1, wherein, after the folding of the upper parts of the length sidewalls and the folding of the upper parts of the width sidewalls:

the upper part of each of the length sidewalls is folded only at the oblique angles, the horizontal score, and the corners between the length sidewall and the width sidewalls; and the upper part of each of the width sidewalls is folded only at the horizontal score and the corner between the width sidewall and the length sidewalls.

9. The method of claim 1, wherein, for each of the oblique scores, the half-width of the box is less than a distance from the end of the oblique score at the upper edge of one of the length sidewalls to a corner of the one of the length sidewalls and one of the width sidewalls at the upper edge.

* * * * *